United States Patent [19]

Christian et al.

[11] Patent Number: 4,799,317

[45] Date of Patent: Jan. 24, 1989

[54] STENCIL DEVICE FOR POST CARDS

[76] Inventors: Felicia M. Christian, 1007 Dekalb St., Apt. 1A, Norristown, Pa. 19401; George Spector, 233 Broadway, Rm 3815, New York, N.Y. 10007

[21] Appl. No.: 115,349

[22] Filed: Nov. 2, 1987

[51] Int. Cl.[4] ..... B43L 13/02

[52] U.S. Cl. ..... 33/565; 434/87

[58] Field of Search ..... 33/562, 563, 564, 565; 434/87

[56] References Cited

U.S. PATENT DOCUMENTS

| | | | |
|---|---|---|---|
| 2,604,702 | 7/1952 | Collins | 33/565 |
| 2,950,537 | 8/1960 | Fixer | 33/565 |
| 3,568,327 | 3/1971 | Furuoka | 33/565 |
| 3,584,385 | 6/1971 | Booth | 33/564 |
| 3,665,612 | 5/1972 | Albright | 33/564 |
| 3,813,787 | 6/1974 | Mercorelli | 33/565 |
| 4,505,044 | 3/1985 | Shaffii-Rad-G | 33/562 |

*Primary Examiner*—William D. Martin, Jr.

[57] ABSTRACT

A stencil device for a post card and the like is provided and consists of a body member with stencil slides that are interchangeable for making various shapes by outlining openings in the slides with a writing instrument. In another form turnable stencil wheels on the body member are utilized for making the various shapes.

2 Claims, 1 Drawing Sheet

STENCIL DEVICE FOR POST CARDS

BACKGROUND OF THE INVENTION

The instant invention relates generally to mailers and more specifically it relates to a stencil device for a post card and the like.

Numerous mailers have been provided in prior art that are adapted to include novelty post cards that are sent to recipients. For example, U.S. Pat. Nos. 3,762,630; 3,986,283 and 4,109,851 all are illustrative of such prior art. While these units may be suitable for the particular purpose to which they address, they would not be as suitable for the purposes of the present invention as heretofore described.

SUMMARY OF THE INVENTION

A primary object of the present invention is to provide a stencil device for a post card and the like that will overcome the shortcomings of the prior art devices.

Another object is to provide a stencil device for a post card and the like that contains stencil slides so as to be interchangeable for making various shapes by outlining the openings in the slides with a writing instrument.

An additional object is to provide a stencil device for a post card and the like that contains stencil wheels which are turnable with respect to the device for making various shapes by outlining the openings in the wheels with a writing instrument.

A further object is to provide a stencil device for a post card and the like that is simple and easy to use.

A still further object is to provide a stencil device for a post card and the like that is economical in cost to manufacture.

Further objects of the invention will appear as the description proceeds.

To the accomplishment of the above and related objects, this invention ma be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
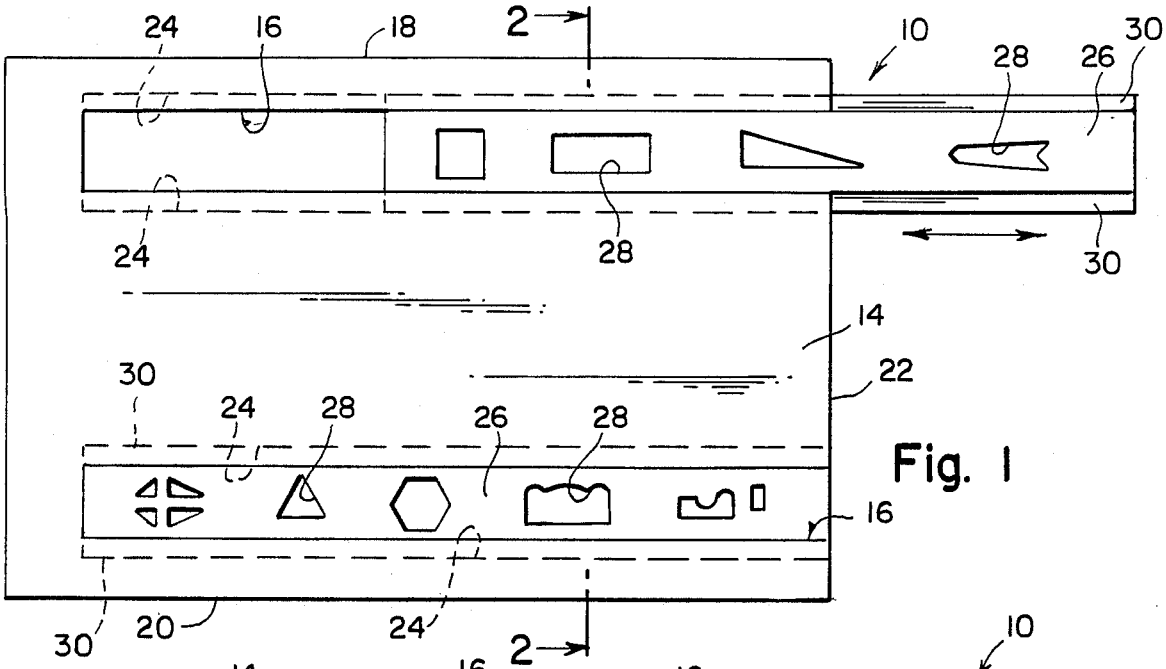
FIG. 1 is a plan view of one form of the invention being a template with stencil slides.
Figure 2:
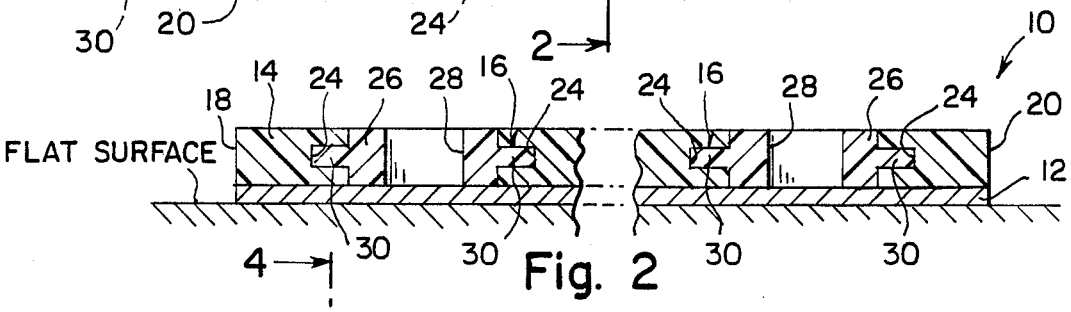
FIG. 2 is an enlarged cross sectional view with parts broken away taken along line 2—2 in FIG. 1 showing the tracks in the stencil slides in greater detail.

Turning now descriptively to the drawings, in which similar reference characters denote similar elements throughout the several views, FIGS. 1 and 2 illustrate a stencil device 10 for a post card 12 and the like consisting of a thin rectangular body member 14 that has two longitudinal spaced apart tracks 16. One of the tracks 16 is near top edge 18 and other of the tracks 16 near bottom edge 20 with both of the tracks extending inwardly from one side edge 22 thereof. Each of the tracks 16 has two oppositely positioned grooves 24 therein.

Two longitudinal stencil slides 26 are also provided. Each slide 26 has a plurality of spaced apart and different geometric shaped openings 28. Each of the slides has two oppositely extending tongues 30 thereon. Each of the tongues 30 on the slides 26 can fit within each of the grooves 24 in the tracks 16 making the slides 16 interchangeable for creating different shapes on the post card 12 and the like when a person (not shown) outlines the openings 28 in the slides 26 with a writing instrument (not shown).

The body member 14 and the stencil slides 26 are each integrally molded out of a tough, synthetic plastic material of sufficient thickness to ensure substantial rigidity thereof.

Figure 3:
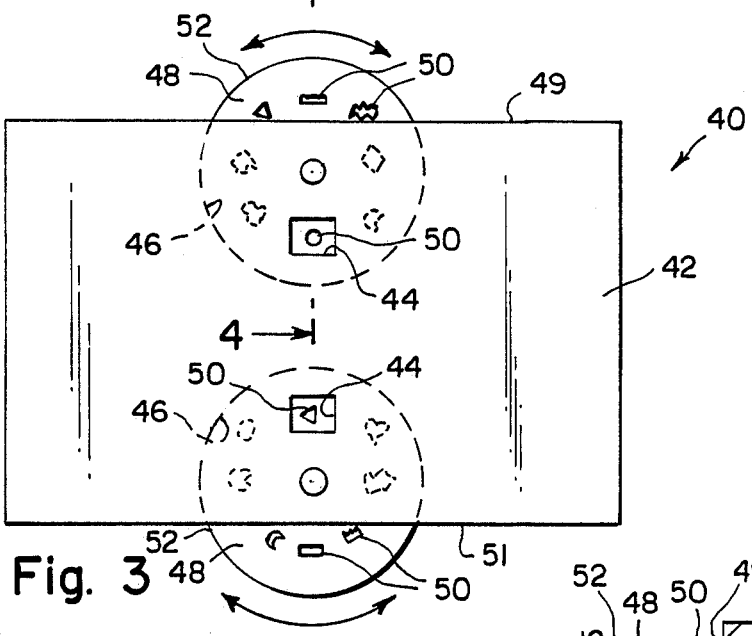
FIG. 3 is a plan view of another form of the invention being a template with stencil wheels.
Figure 4:
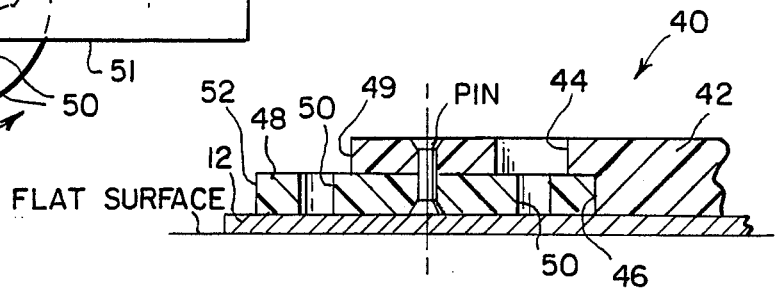
FIG. 4 is an enlarged cross sectional view taken along line 4—4 in FIG. 3 showing one of the stencil wheels in greater detail.

FIGS. 3 and 4 show another type of stencil device 40, which consists of a thin rectangular body member 42 that has two spaced apart windows 44 above two spaced apart bottom curved recesses 46. One of the windows 44 and one of the recesses 46 are near top edge 48 and other of the windows 42 and other of the recesses 46 are near bottom edge 50 with each of the windows 44 extending through the body member 42 into each of the recesses 46.

Two stencil wheels 48 are provided. Each have a plurality of radially spaced apart and different geometric shaped openings 50. Each of the wheels 48 fit within each of the recesses 46 of the body member 42 so that each of the openings 50 can line up with one of the windows while a portion of circumference 52 of each of the wheels 48 extend past top and bottom edges 48 and 50 of the body member 42.

Two pivot pins 54 are also provided. Each extends through the body member 42 and into center of one of the stencil wheels 48 so that the stencil wheels can each be turned within the recesses 46 to create different shapes on the post card 12 and the like when the person outlines the openings 50 in the stencil wheels 48 through each of the windows 44 with the writing instrument.

The body member 42 and the stencil wheels 48 are each integrally molded out of a tough, synthetic plastic material of sufficient thickness to ensure substantial rigidity thereof.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A stencil device for a post card and the like, which comprises:

(a) a thin rectangular body member having two spaced apart windows above two spaced apart bottom curved recesses, one of said windows and one of said recesses near top edge and other of said windows and other of said recesses near bottom edge with each of said windows extending through said body member into each of said recesses;

(b) two stencil wheels, each having a plurality of radially spaced apart and different geometric shaped openings, each of said wheels fit within each of said recesses of said body member so that each of said openings can line up with one of said windows while a portion of circumference of each of said wheels extend past top and bottom edges of said body member; and (c) two pivot pins, each extending through said body member and into center of one of said stencil wheels so that said stencil wheels can each be turned within said recesses to create different shapes on the post card and the like when a person outlines said openings in said stencil wheels through each of said windows with a writing instrument.

2. A. stencil device as recited in claim 1, wherein said body members and said stencil wheels are each integrally molded out of a tough, synthetic plastic material of sufficient thickness to ensure substantial rigidity thereof.

* * * * *